US011445750B2

(12) United States Patent
Lai et al.

(10) Patent No.: US 11,445,750 B2
(45) Date of Patent: Sep. 20, 2022

(54) POT STRUCTURE OF ELECTRONIC CIGARETTE FOR BAKING TOBACCO

(71) Applicant: ALD GROUP LIMITED, Shenzhen (CN)

(72) Inventors: Chuanzhi Lai, Shenzhen (CN); Yi Ding, Shenzhen (CN)

(73) Assignee: ALD Group Limited, Shenzhen (CN)

( * ) Notice: Subject to any disclaimer, the term of this patent is extended or adjusted under 35 U.S.C. 154(b) by 651 days.

(21) Appl. No.: 16/483,387

(22) PCT Filed: May 25, 2017

(86) PCT No.: PCT/CN2017/085801
§ 371 (c)(1),
(2) Date: Aug. 2, 2019

(87) PCT Pub. No.: WO2018/192057
PCT Pub. Date: Oct. 25, 2018

(65) Prior Publication Data

US 2020/0008475 A1 Jan. 9, 2020

(30) Foreign Application Priority Data

Apr. 20, 2017 (CN) ..... 201710260399.0

(51) Int. Cl.
*A24F 7/04* (2006.01)
*A24F 47/00* (2020.01)
(Continued)

(52) U.S. Cl.
CPC ..... *A24F 7/04* (2013.01); *A24F 40/42* (2020.01); *A24F 40/46* (2020.01); *A24F 40/485* (2020.01);
(Continued)

(58) Field of Classification Search
None
See application file for complete search history.

(56) References Cited

U.S. PATENT DOCUMENTS

2015/0208730 A1* 7/2015 Li ..... A24F 40/485
131/329
2017/0215474 A1* 8/2017 Li ..... A24F 40/485
2020/0008476 A1* 1/2020 Ouyang ..... A24F 40/46

FOREIGN PATENT DOCUMENTS

CN 103783674 A 5/2014
CN 205456069 U 8/2016
(Continued)

*Primary Examiner* — Joseph M. Pelham
(74) *Attorney, Agent, or Firm* — Robert L. Stearns; Dickinson Wright, PLLC

(57) ABSTRACT

A pot structure of electronic cigarette for baking tobacco, the pot structure is disposed in a rod portion of the electronic cigarette, and the pot structure is in communication with a mouth piece of the electronic cigarette; the structure includes: a cage, configured to receive tobacco shreds; a heating device, configured to heat tobacco shreds within the cage to generate smoke; the heating device is a heating pot in a cup-shaped, and the cage is a cup-shaped body made of a good heat conductive material; the heating pot heats the tobacco shreds in the cage from a side of the cage, and the heat conductive tube is configured to bring the heat of the heating pot to the center of the tobacco shreds to heat the tobacco shreds, such that the heating to the tobacco shreds is more evenly.

15 Claims, 1 Drawing Sheet

(51) Int. Cl.

| | |
|---|---|
| ***H05B 3/06*** | (2006.01) |
| ***H05B 3/18*** | (2006.01) |
| ***A24F 40/42*** | (2020.01) |
| ***A24F 40/46*** | (2020.01) |
| ***A24F 40/485*** | (2020.01) |
| ***H05B 3/44*** | (2006.01) |
| ***H05B 3/10*** | (2006.01) |
| *A24F 40/20* | (2020.01) |

(52) U.S. Cl.
CPC ..... *H05B 3/06* (2013.01); *H05B 3/10* (2013.01); *H05B 3/18* (2013.01); *H05B 3/44* (2013.01); *A24F 40/20* (2020.01); *H05B 2203/03* (2013.01)

(56) References Cited

FOREIGN PATENT DOCUMENTS

| | | | | |
|---|---|---|---|---|
| CN | 205624464 | U | 10/2016 | |
| CN | 206005956 | U | 3/2017 | |
| WO | 2017053994 | A1 | 3/2017 | |
| WO | WO-2020073730 | A1 * | 4/2020 | ..... A24B 3/10 |

* cited by examiner

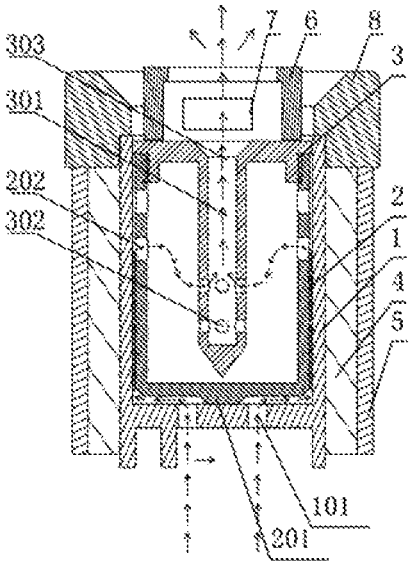
303
301
202
302
7
6
8
3
2
1
4
5
101
201

POT STRUCTURE OF ELECTRONIC CIGARETTE FOR BAKING TOBACCO

CROSS-REFERENCE TO RELATED APPLICATION

This application is a 35 U.S.C. § 371 national stage application of PCT Applicaton Serial No. PCT/CN2017/085801 fied on May 25, 2017, which claims priority to Chinese Patent Application Ser. No. CN201710260399.0, filed on Apr. 20, 2017, each of which are hereby incorporated by reference in their entireties.

TECHNICAL FIELD

The present application relates to the field of structure of an electronic cigarette, and more particularly to a pot structure of an electronic cigarette for baking tobacco.

BACKGROUND TECHNOLOGY

A pot is a container for accommodating burning tobacco shreds when smoking. At present, that which of electronic cigarette for heating tobacco, used for accommodating tobacco shreds and heating but not burning it, is also called as a pot of electronic cigarette. The Chinese Patent with Publication No. CN 104839887 A discloses an electronic cigarette pot which is composed of a pot body, a heating resistor and a lead wire. The pot body is a cup-shaped structure with a hole at the bottom, a ring-shaped wall of the pot body is provided with the heating resistor, and the lead wire is electrically connected with the heating resistor. The electronic cigarette pot needs to be connected to the power supply during used, and further require to be connected with a rod of cigarette bag and a nozzle of cigarette bag to form a cigarette bag for the smoker to use. The power supply and the heating resistor of the electronic cigarette pot form a switchable electrical connection; when the electronic cigarette pot is in use, the tobacco shreds are put into the pot body, and the lead wire is connected to the power supply and energized, the current passes through the heating resistor in the pot wall, and the heating resistor generates heat to heat the wall of the pot, and then the tobacco shreds in the pot body are heated. The power of the heating resistor is configured such that when the heating resistor is energized, the heating temperature ranges from 400° C. to 650° C., and during which the tobacco in the pot body is not burned, but obtains an effect as flue-cured tobacco to make the tobacco shreds release aroma. The aroma releasing form the tobacco shreds enters the mouth of the smoker through the rod of cigarette bag and the nozzle of the cigarette bag. Since the tobacco is not burned, thus won't release toxic substances, but just release the aroma as flue-cured tobacco. Therefore the smoking needs of the smokers are satisfied, and the health of the smokers and their surrounding people is not affected.

This is an electronic cigarette that satisfies the smoking needs of smokers without affecting the health of smokers and those around them.

However, such a pot of the electronic cigarette has the following disadvantages:

The heating resistor disposed in the ring-shaped wall of the pot body is used to bake the tobacco (tobacco shreds), as a point heating source, it will heat the tobacco shreds in the pot body unevenly, which may cause some tobacco shreds to be baked too fully to be wasted.

The way of air entering through the hole on the bottom of the pot and the smoking discharging from the opening of the pot is not adequate to allow the air to carry away the most effective components of the tobacco shreds.

SUMMARY

An object of the present application is to solve the issue of the present pot of an electronic cigarette, and provide a pot structure of an electronic cigarette for baking tobacco, the heating device of the pot for heating the tobacco is a surface heating source, and the airflow can be passed through the tobacco fully.

A technical solution of the present application for achieving the object is providing a pot structure of an electronic cigarette for baking tobacco, the pot structure is disposed in a rod portion of the electronic cigarette, and having an inner portion in communication with a mouth piece; the pot structure comprising:

a cage, configured to receive tobacco shreds;

a heating device, configured to heat the tobacco shreds within the cage to generate smoke;

the heating device is a cup-shaped heating pot, and the cage is a cup-shaped body made of a good heat conductive material;

a bottom of the heating pot defines an air hole;

the cage is disposed in the heating pot, and a bottom of the cage is provided with a protrusion, an upper portion of a sidewall of the cage defines air inlet holes; and a diameter of an outer wall of the cage is less than a diameter of an inner wall of the heating pot, to form an air inlet channel configured to allow air to enter the heating pot via the air hole, and then flow to the air inlet hole entering the cage via a gap between the inner wall of the heating pot and the outer wall of the cage; and the pot structure further comprises a cage cover, made of a good heat conductive material, and a diameter of the cage cover is identical to an inner diameter of the heating pot; a center of the cage cover is provided with a cylinder heat conductive tube extending to the bottom of the cage, a part of a tube wall of the heat conductive tube close to the bottom of the cage is provided with an aperture, and a root portion of the heat conductive tube is in communication with the mouth piece to form a smoke channel configured to enable the smoke from the cage to enter the heat conductive tube and then enter into the mouth piece.

In the present application, the heating pot heats the tobacco shreds in the cage from a side of the cage, and the heat conductive tube is configured to bring the heat of the heating pot to the center of the tobacco shreds to heat the tobacco shreds at the center, such that the heating to the tobacco shreds is more evenly. The air entering from the hole of the bottom of the heating pot is fully heated during flowing through the gap between the inner wall of the heating pot and the outer wall of the cage, due that the air entering the cage is already heated air, therefore won't bring uneven warm or cold distribution as if the air flows into the cage directly. The air entering form the upper portion of the cage flows from the upper portion to the lower portion and flows out from the middle of the heat conductive tube, such that the smoke generated by the baked tobacco are fully carried away.

Further, in the pot structure of an electronic cigarette for baking tobacco, the cage cover is in screwed connection with the cage for conveniently fixing the tobacco shreds in the cage.

Further, in the pot structure of an electronic cigarette for baking tobacco, a width of the gap between the inner wall of the heating pot and the outer wall of the cage is in a range of 0.1-0.25 mm.

Experiments have shown that the heat conductive efficiency of the gap between the inner wall of the heating pot and the outer wall of the cage is the highest when the width of the gap is 0.18 mm.

Further, in the pot structure of an electronic cigarette for baking tobacco, the outer wall of the heating pot is further provided with a heat retaining device. The heat retaining device comprises a heat retaining cotton wrapped around the outer wall of the heating pot, and a mica tube sleeved outside the heat retaining cotton. The heat retaining cotton and the mica tube are configured to separate the heating pot from outside, and ensuring the heating effect of the heating pot.

Further, in the pot structure of an electronic cigarette for baking tobacco, the cage cover is further provided with a heat insulating pad thereon, at the middle of the heat insulating pad is provided with a filter device, and the filter device is disposed outside the root portion of the heat conductive tube of the cage cover, and an outside of the heat insulating pad is sleeved with a heat insulation sleeve.

The present application will be described in detail below with reference to specific embodiments.

BRIEF DESCRIPTION OF THE DRAWINGS

FIG. 1 is a structural view of a pot structure of an electronic cigarette for baking tobacco according to the present application.

In the drawing, the same numerals refer to the same structure;

1 heating pot; 101 air hole; 2 cage; 201 protrusion; 202 air inlet hole; 3 cage cover; 301 heat conductive tube; 302 aperture; 303 root portion; 4 heat retaining cotton; 5 mica tube; 6 heat insulation pad; 7 filter device; 8 heat insulation sleeve.

DETAILED DESCRIPTION

Embodiment 1

The present application is a pot structure of an electronic cigarette for baking tobacco. In the embodiment, the pot is a device configured to receive tobacco shreds, and to heat the tobacco shreds in a high temperature to form smoke, and two ends of the pot structure are respectively connected to a mouth piece and a battery rod of the electronic cigarette, the battery rod is configured to supply energy to the pot structure, the tobacco shreds are heated in a high temperature when an electrical heating device of the pot structure is energized; the other end of the pot structure is connected to mouth piece such that the smoke generated in the pot structure is sucked out from the mouth piece.

As shown in FIG. 1, in the present embodiment, the pot structure mainly includes a heating pot 1 and a cage 2, and the heating pot 1 and the cage 2 are each a cylindrical shape, and optionally, the heating pot 1 and the cage 2 are each cup-shaped. As shown in the FIG. 1, the heating pot 1 itself is a ceramic heating tube, an end of the ceramic heating tube closed to form the bottom of the heating pot 1, and the other end is open to form the heating pot 1. The closed end of the ceramic heating tube is connected to the battery rod, and an end surface of the closed end is provided with a ring-shaped air hole 101, such that the air entering from outside of the electronic cigarette is entered into the heating pot via the air hole 101. The bottom of the heating pod is provided with two electrodes electrically connected with a battery in the battery rod, the battery supplies power to the heating pot 1, and the heating pot generates heat. We know that the ceramic heating tube is uniformly added with a heating resistance wire in a porous ceramic, such that the heat of the electric resistance wire uniformly disposed in the porous ceramic tube is uniformly emitted on the ceramic tube, and the inside of the heating pot 1 can be uniformly heated. The ceramic heating tube can also be coated with a heat-generating coating on the inner wall of the ceramic tube, and when the heating coating is energized, it can be uniformly heated.

The cage 2 is a metal tube, such as aluminum metal or other metal tube of good heat conductor. An end of the metal tube is closed to form the bottom of the cage 1 and the other end is an opening of the cage 2, which is used for receiving tobacco shreds. The tobacco shreds are put into the cage 2 from the opening, and after the cage 2 is fulfilled with the tobacco shreds, it will be put into the heating pot 1, with the bottom of the cage 2 nearing the bottom of the heating pot 1. In present embodiment, when the cage 2 is put into the heating pot 1, a gap is formed between an outer wall of the cage 2 and an inner wall of the heating pot 1, and a width of the gap is generally in a range of 0.1-0.25 mm, and optionally, the width of the gap is 0.18 mm, such that the heat transfer efficiency is the highest. An outer wall of a bottom of the cage 2 is provided with a protrusion 201, such that when the cage 2 is put in the heating pot 1, the air hole 101 won't blocked by the bottom of the cage 2, at an upper portion of the wall of the cage 2 is provided with a plurality of air inlet holes 202, such that the air entering from the air hole 101 of the bottom of the heating pot 1 flows along the gap between the inner wall of the heating pot 1 and outer wall of the cage 2 upwardly to the air inlet holes 202, and enters the cage 2 from the air inlet holes 202.

Above the cage 2 is a cage cover 3, and the cage cover 3 is in screwed connection to the upper portion of the heating pot 1, in the embodiment, the diameter of the cage cover 3 is larger than the diameter of the cage 2 by 0.4 mm, a closed space is formed between the heating pot 1 and the cage 2 using the 0.4 mm. In the embodiment, the cage cover 3 itself is made of metal of a good heat conductor or other good heat conductor, the center of the cage cover 3 is extended with a heat conductive tube 301 toward the bottom of the cage 2, and part of the heat conductive tube 301 close to the bottom of the cage 2 is provided with a plurality of apertures 302, the smoke in the cage 2 enters the heat conductive tube 301 via the apertures 302, and enters into the mouth piece from the root portion of the heat conductive tube 301 to be inhaled by a smoker. The heat conductive tube 301 thermally conducts the heat radiated from the surrounding part of cage cover 3 which is closely adjacent to the inner wall of the heating pot 1 to the tobacco shreds in the cage 2 to heat the tobacco shreds more uniformly.

In order to ensure the heating effect of the heating pot 1, the outer wall of the heating pot 1 is wrapped with a layer of heat insulation cotton 4, and an outside of the heat insulation cotton 4 is sleeved with a mica tube 5, such that after the two-layer-insulation sheet composed of the heat insulation cotton 4 and the mica tube 5 are arranged on the outer wall of the heating pot 1, heat of the heating pot 1 is ensured not be conducted to the outside, but just conducted into the cage 2. The heating pot 1 arranged with the insulation sheet can be directly mounted in the housing of the electronic cigarette.

A heat insulating pad 6 is further disposed on the cage cover 3, and a filter device 7 is arranged in the heat insulation pad 6, the smoke from the root portion of the heat conductive tube enters the mouth piece after filtered by the sponge pad of the filter device 7. An outside of the heat insulation pad 6 is further mounted with a heat insulation sleeve 8, and the heat insulation sleeve 8 together with the mica tube 5 encloses the heating pot 1 therein.

The operation process of the electronic cigarette that mounted with the pot structure of the present application is as follows:

1. unplugging the mouth piece and putting the cage with the tobacco shreds into the heating pot, and then covering the mouth piece.

2. controlling the battery rod to supply power to the heating pot by pressing a button mounted outside the rod portion of the electronic cigarette, the heating pot generates heat and radiates the heat through the inner wall to the cage, and the cage cover and the heat conductive tube directly conducts heat to the tobacco shreds.

3. the tobacco shreds are quickly heated to 260 to 300° C., at this time, the smoker sucks from the mouth piece, and a negative pressure is formed in the cage, the outside air enters the heating pot from the air hole at the bottom of the heating pot, and flows into the cage via the air inlet holes of the cage by the gap between the inner wall of the heating pot and the outer wall of the cage; due that the temperature of the tobacco shreds in the cage is high, the effective components on the tobacco shreds are formed into smoke by heating, and the smoke enters the heat conductive tube via the aperture of the heat conductive tube close to the bottom of the cage, and flows out from the root portion of the heat conductive tube, and then is sucked by the smoker from the mouth piece after filtering via the filter device. The airflow is shown by the arrow in FIG. 1.

What is claimed is:

1. A pot structure of electronic cigarette for baking tobacco, disposed in a rod portion of the electronic cigarette, and having an inner portion in communication with a mouth piece; the pot structure comprising:

a cage, configured to receive tobacco shreds;

a heating device, configured to heat the tobacco shreds within the cage to generate smoke;

wherein the heating device is a cup-shaped heating pot, and the cage is a cup-shaped body made of a good heat conductive material;

a bottom of the heating pot defines an air hole;

the cage is disposed in the heating pot, and a bottom of the cage is provided with a protrusion, an upper portion of a sidewall of the cage defines air inlet holes; and a diameter of an outer wall of the cage is less than a diameter of an inner wall of the heating pot, to form an air inlet channel configured to allow air to enter the heating pot via the air hole, and then flow to the air inlet holes entering the cage via a gap between the inner wall of the heating pot and the outer wall of the cage; and the pot structure further comprises a cage cover, made of a good heat conductive material, wherein a diameter of the cage cover is identical to an inner diameter of the heating pot; at the center of the cage cover is provided with a cylinder heat conductive tube extending to the bottom of the cage, a part of a tube wall of the heat conductive tube close to the bottom of the cage is provided with an aperture, and a root portion of the heat conductive tube is in communication with the mouth piece to form a smoke channel configured to enable the smoke from the cage to enter the heat conductive tube and then enter into the mouth piece.

2. The pot structure of electronic cigarette for baking tobacco of claim 1, wherein the cage cover is in screwed connection with the cage.

3. The pot structure of electronic cigarette for baking tobacco of claim 1, wherein a width of the gap between the inner wall of the heating pot and the outer wall of the cage is in a range of 0.1-0.25 mm.

4. The pot structure of electronic cigarette for baking tobacco of claim 1, wherein an outer wall of the heating pot is further provided with a heat retaining device.

5. The pot structure of electronic cigarette for baking tobacco of claim 4, wherein the heat retaining device comprises a heat retaining cotton wrapped around the outer wall of the heating pot, and a mica tube sleeved outside the heat retaining cotton.

6. The pot structure of electronic cigarette for baking tobacco of claim 1, wherein the cage cover is further provided with a heat insulating pad thereon, a middle of the heat insulating pad is provided with a filter device, and the filter device is disposed outside the root portion of the heat conductive tube of the cage cover.

7. The pot structure of electronic cigarette for baking tobacco of claim 6, wherein an outside of the heat insulating pad is sleeved with a heat insulation sleeve.

8. The pot structure of electronic cigarette for baking tobacco of claim 2, wherein an outer wall of the heating pot is further provided with a heat retaining device.

9. The pot structure of electronic cigarette for baking tobacco of claim 3, wherein an outer wall of the heating pot is further provided with a heat retaining device.

10. The pot structure of electronic cigarette for baking tobacco of claim 8, wherein the heat retaining device comprises a heat retaining cotton wrapped around the outer wall of the heating pot, and a mica tube sleeved outside the heat retaining cotton.

11. The pot structure of electronic cigarette for baking tobacco of claim 9, wherein the heat retaining device comprises a heat retaining cotton wrapped around the outer wall of the heating pot, and a mica tube sleeved outside the heat retaining cotton.

12. The pot structure of electronic cigarette for baking tobacco of claim 2, wherein the cage cover is further provided with a heat insulating pad thereon, a middle of the heat insulating pad is provided with a filter device, and the filter device is disposed outside the root portion of the heat conductive tube of the cage cover.

13. The pot structure of electronic cigarette for baking tobacco of claim 3, wherein the cage cover is further provided with a heat insulating pad thereon, a middle of the heat insulating pad is provided with a filter device, and the filter device is disposed outside the root portion of the heat conductive tube of the cage cover.

14. The pot structure of electronic cigarette for baking tobacco of claim 12, wherein an outside of the heat insulating pad is sleeved with a heat insulation sleeve.

15. The pot structure of electronic cigarette for baking tobacco of claim 13, wherein an outside of the heat insulating pad is sleeved with a heat insulation sleeve.

* * * * *